US009994422B2

(12) United States Patent
Hiltunen et al.

(10) Patent No.: US 9,994,422 B2
(45) Date of Patent: Jun. 12, 2018

(54) TOUCH-SENSITIVE CALL-GIVING DEVICE

(71) Applicant: KONE Corporation, Helsinki (FI)

(72) Inventors: Jussi Hiltunen, Helsinki (FI); Tommi Salonen, Helsinki (FI); Kim Bergman, Helsinki (FI); Jarmo Parkkinen, Espoo (FI)

(73) Assignee: KONE CORPORATION, Helsinki (FI)

( * ) Notice: Subject to any disclaimer, the term of this patent is extended or adjusted under 35 U.S.C. 154(b) by 331 days.

(21) Appl. No.: 14/708,871

(22) Filed: May 11, 2015

(65) Prior Publication Data

US 2015/0246790 A1 Sep. 3, 2015

Related U.S. Application Data

(63) Continuation of application No. PCT/FI2013/051070, filed on Nov. 12, 2013.

(30) Foreign Application Priority Data

Nov. 12, 2012 (FI) ..... 20126182

(51) Int. Cl.

| | |
|---|---|
| ***B66B 1/34*** | (2006.01) |
| ***B66B 1/24*** | (2006.01) |
| ***B66B 1/46*** | (2006.01) |

(52) U.S. Cl.

CPC ..... *B66B 1/2458* (2013.01); *B66B 1/3415* (2013.01); *B66B 1/461* (2013.01); *B66B 1/463* (2013.01); *B66B 2201/463* (2013.01); *B66B 2201/4615* (2013.01); *B66B 2201/4653* (2013.01)

(58) Field of Classification Search

CPC ..... B66B 1/2458; B66B 1/3415; B66B 1/461; B66B 1/463; B66B 2201/4615; B66B 2201/463; B66B 2201/4653

USPC ..... 187/247, 380–388, 391, 393, 395, 396

See application file for complete search history.

(56) References Cited

U.S. PATENT DOCUMENTS 5,594,469 A * 1/1997 Freeman ..... G05B 19/106 345/157
5,679,933 A * 10/1997 Weber ..... B66B 1/462 187/389
5,805,161 A * 9/1998 Tiphane ..... G06F 3/04855 345/663
6,315,083 B1 11/2001 Schuster et al.
(Continued)

FOREIGN PATENT DOCUMENTS

WO WO 2012/143612 A1 10/2012

*Primary Examiner* — Anthony Salata
(74) *Attorney, Agent, or Firm* — Birch, Stewart, Kolasch & Birch, LLP

(57) ABSTRACT

A destination call-giving device for giving destination calls in an elevator system includes a device available to a user for selecting a destination floor from a plurality of floors that are in a certain sequence, and an output for communicating the selected destination floor to the control system of the elevator system. The device for selecting a destination floor includes a touch-sensitive display forming a user interface for presenting to the user information related to the selection of a destination floor and for receiving the input of the user. The destination floor is arranged to be selectable by the user from the aforementioned plurality of floors by moving a touch-sensitive point on a touch-sensitive display.

16 Claims, 2 Drawing Sheets

(56) References Cited

U.S. PATENT DOCUMENTS

| | | | | |
|---|---|---|---|---|
| 6,902,041 | B2 * | 6/2005 | Eccleston | B66B 1/463 187/380 |
| 8,457,353 | B2 * | 6/2013 | Reville | G06F 3/011 382/103 |
| 8,763,762 | B2 * | 7/2014 | Finschi | B66B 1/468 187/391 |
| 9,045,314 | B2 * | 6/2015 | Finschi | B66B 1/467 |
| 9,134,799 | B2 * | 9/2015 | Mark | G06F 1/1639 |
| 9,561,931 | B2 * | 2/2017 | Kauppinen | B66B 1/468 |
| 2001/0035314 | A1 | 11/2001 | Yoshida et al. | |
| 2012/0097488 | A1 | 4/2012 | Taiana | |
| 2012/0138388 | A1 | 6/2012 | Finschi et al. | |
| 2014/0173529 | A1 * | 6/2014 | Hicks | G06F 3/04883 715/863 |

* cited by examiner 1, 1' - call-giving device
2 - processing unit
3, 3' - touch-sensitive display
15 - data transfer channel

TOUCH-SENSITIVE CALL-GIVING DEVICE

CROSS REFERENCE TO RELATED APPLICATIONS

This application is a Continuation of PCT International Application No. PCT/FI2013/051070, filed on Nov. 12, 2013, which claims priority under 35 U.S.C. 119(a) to Patent Application No. 20126182, filed in Finland on Nov. 12, 2012, all of which are hereby expressly incorporated by reference into the present application.

FIELD OF THE INVENTION

The invention relates to elevator systems applicable to the transportation of people and/or of freight. More particularly the invention relates to the giving of calls in an elevator system.

BACKGROUND OF THE INVENTION

Passengers using elevators can give calls to elevators in an elevator car and/or in an elevator lobby. Elevator lobbies are typically provided with up/down pushbuttons, by means of which a passenger can order an elevator to the call floor and simultaneously indicate his/her travel direction. After the elevator has arrived at the call-giving floor, the passenger moves into the elevator car and indicates his/her destination floor with the pushbuttons of the car panel in the elevator car. To a constantly increasing extent so-called destination call systems are used in high-rise buildings, in which systems a passenger indicates his/her destination floor already in the elevator lobby before going into the elevator car. For giving destination calls the elevator lobbies are provided with destination operating panels. Destination operating panels are generally provided with a so-called decimal numeric keypad and a display means. If a passenger is going e.g. to floor 24, he/she keys into the decimal numeric keypad first the number 2 and then the number 4. The destination operating panel sends the data about the call-giving floor and about the aforementioned floor 24 to the control system of the elevator system. The control system comprised in the elevator system allocates the optimal elevator for the use of the passenger and transmits information about this to the call-giving panel, to the display means, on which appears e.g. the text "Elevator B". In this way the elevator system identifies to the user in response to a destination call the elevator allocated to him/her. One problem is that the use of a decimal numeric keypad is slow. Another problem is that since a decimal numeric keypad enables, in principle, the keying in of any floor number whatsoever, this easily results in erroneous keyings. A passenger can, for example, key in a destination call to a floor that the elevator system does not serve or the floor is temporarily locked. For rectifying incorrect keying, the occurrence of an error must be indicated and the keying in must be performed again. This slows down use of the system. It is also possible that there is an access control system in use in the building, with which system the access of passengers to floors within the scope of the access control can be limited. Another problem in prior-art solutions is that a call-giving device can give to the user information relating to the destination floor poorly. For example, in the case of a decimal numeric keypad a call-giving device cannot give information to the user about the destination floor before the user has entered the destination floor into the device. Thus information about the destination floor cannot be efficiently offered to the user. Yet another problem is that solutions according to prior art do not enable rapid floor selection in a building having selectable floors with an identifier string that comprises three-digit floor numbers. For example, in the case of a decimal numeric keypad the production of a three-digit number is slow. Yet another problem of a solution utilizing a decimal numeric keypad is that it is restricted to very simple floor identifiers presented in numerical format. Yet another problem is that for a selection in solutions according to prior art a large number of icons, pushbuttons, et cetera, must be presented to a user. Thus, the display must be large in size and the solutions are not well suited to portable call-giving devices, in which the size of the display cannot be large. With regard to portable call-giving devices, a further problem is that the system does not necessarily know from which floor a call has come.

BRIEF DESCRIPTION OF THE INVENTION

The aim of the invention is to solve the aforementioned problems of prior-art solutions as well as the problems disclosed in the description of the invention below. More particularly, the aim is to improve the call-giving of an elevator system. Among other things, some embodiments are presented wherein the giving of a destination call, and more particularly the selection of a destination floor belonging to it, is fast and simple to perform. Likewise, the selection can be made in a manner, utilizing which the number of erroneous selections remains small. Among other things, some embodiments are presented wherein the giving of a destination call can be performed with a small-sized touch-sensitive display. Among other things, some embodiments are presented wherein the giving of a destination call can be performed with a portable destination call-giving device.

A destination call-giving device according to the invention for giving destination calls in an elevator system is disclosed, which destination call-giving device comprises means available to a user for selecting a destination floor from a plurality of floors that are in a certain sequence, and an output for communicating the selected destination floor to the control system of the elevator system, which means for selecting a destination floor comprise a touch-sensitive display forming a user interface for presenting to the user information related to the selection of a destination floor and for receiving the input of the user. The destination floor is arranged to be selectable by the user from the aforementioned plurality of floors by moving a touch-sensitive point on a touch-sensitive display. In this way a user can make a selection with a simple procedure. In this case also it is not necessary to present a large amount of graphics, such as icons, buttons, marks, et cetera, on the touch-sensitive display. Owing to this the giving of a destination call can be performed with a small-sized touch-sensitive display. On the other hand, if a touch-sensitive display of large size can be used, additional information fits to be presented on the touch-sensitive display, because now the amount of graphics required by indispensable functions is small. In this case also the presentation of graphics in large size in relation to the size of the touch-sensitive display becomes possible.

In one preferred embodiment the means for selecting a destination floor, preferably the processing unit comprised in them, are arranged to detect the movement of a touch-sensitive point on a touch-sensitive display, and to change the selected destination floor on the basis of the movement of the touch-sensitive point.

In one preferred embodiment the aforementioned means for selecting a destination floor comprise a processing unit for processing a touch signal received from a touch-sensitive display and for executing program commands, which processing unit preferably comprises a processor, which can be brought into data transfer connection with a memory, which is comprised in the processing unit or is separate from it and stores program commands and/or information relating to the aforementioned floor plurality. This information relating to the program commands/floor plurality is related to the selection of a destination floor from the aforementioned plurality of floors.

In one preferred embodiment the processing unit comprises a processor, and connected to the processor an input from the control system of the elevator system, and an input from the touch-sensitive display, and an output to the control system of the elevator system, and an output to the touch-sensitive display, and preferably also a memory.

In one preferred embodiment the means for selecting a destination floor are arranged to present on a touch-sensitive display a sliding indicator to be moved in a first and a second direction, said directions being opposite to each other, which sliding indicator can be moved with the aforementioned movement of a touch-sensitive point. More particularly, the aforementioned means for selecting a destination floor present a sliding indicator to be moved in a first and a second direction, said directions being opposite to each other, by moving which sliding indicator the destination floor is arranged to be selectable from the aforementioned plurality of floors. By means of the position of the moving sliding indicator, the right way to operate the device can be indicated to a user. Likewise an indication to the user of the sequential location (in the floor plurality series) of the selected destination floor becomes possible. In addition, a sliding indicator makes a device very quick for a user to learn. It is also universally simple to use. It can also be presented very space-efficiently. Its implementation does not require heavy software either.

In one preferred embodiment the means for selecting a destination floor, more particularly the processing unit comprised in them, are arranged to present on a touch-sensitive display a sliding indicator to be moved in a first and a second direction, said directions being opposite to each other, and to detect a touch at the point of the sliding indicator, and to detect movement of the touch-sensitive point on the touch-sensitive display, and to change the selected destination floor and the position of the sliding indicator on the touch-sensitive display on the basis of the movement of the touch-sensitive point.

In one preferred embodiment the sliding indicator has a limited range of movement on the touch-sensitive display, which range of movement has a first end and a second end. Preferably the position of the sliding indicator at the first end of the range of movement corresponds to the selection of the topmost floor of the aforementioned floor plurality, and the position of the sliding indicator at the second end of the range of movement corresponds to the selection of the bottommost floor of the aforementioned floor plurality. In this way the operating method of the sliding indicator can be indicated to the user and indication of the sequential position of the selected destination floor to the user is enabled.

In one preferred embodiment the range of movement of the sliding indicator covers the position of the sliding indicator for each (every) floor of the aforementioned plurality. In this way the whole floor plurality can be simply presented at one time. In this way it is quick for a user to select a destination floor based on his/her understanding of at which point in the sequence his/her destination floor is situated.

In one preferred embodiment the whole range of movement of the sliding indicator is shown on the touch-sensitive display. In this way the selection is fast and simple. In this way it is quick for a user to select a destination floor based on his/her understanding of at which point in the sequence his/her destination floor is situated.

In one preferred embodiment the range of movement of the sliding indicator covers at least most, preferably at least 75% of the length of the touch-sensitive display. When the range of movement is long, the selection accuracy is good also when the number of floors is large.

In one preferred embodiment the moving of the touch-sensitive point on the touch-sensitive display in the first direction is arranged to change the selected destination floor in sequence in a first direction and the moving of the touch-sensitive point on the touch-sensitive display in the second direction is arranged to change the selected destination floor in sequence in a second direction. In this way the selection is fast to perform, because the selection logic is fast to discover and learn.

In one preferred embodiment the destination call-giving device is portable, preferably in the form of a mobile phone or a tablet. In this way a user can send a destination calf from a location of his/her choice.

In one preferred embodiment the destination call-giving device is a destination call-giving device permanently installed into its position in the proximity of the elevator, preferably in an elevator lobby.

In one preferred embodiment the aforementioned plurality of floors that are in a certain sequence, from which floors the destination floor is arranged to be selectable, is arranged to be presented to the user as a series on a touch-sensitive display, which series is arranged to be browseable by moving a touch-sensitive point on the touch-sensitive display.

In one preferred embodiment the aforementioned plurality of floors that are in a certain sequence, from which floors the destination floor is arranged to be selectable, is arranged to be presented to the user as a series of floor identifiers, in which case a floor identifier corresponds to each floor.

In one preferred embodiment the selected destination floor is arranged to be presented to the user on a touch-sensitive display. In this way the user knows the current selection. In this way he/she can also change the selection, if necessary.

In one preferred embodiment other information related to the selected destination floor is additionally arranged to be presented to the user on a touch-sensitive display.

In one preferred embodiment the destination call-giving device comprises an input for receiving an electrical signal from the control system of the elevator. In this way a destination call-giving device can transmit from the control system to a user information about the elevator allocated to him/her.

In one preferred embodiment it is arranged to check the access right of a user to the floors of the aforementioned plurality or to the selected destination floor, and to indicate to the user if the user does not have an access right to some floor. In this way a destination call-giving device can function as a part of an access control system. Preferably a user cannot select as a destination floor a floor to which he/she does not have an access right.

In one preferred embodiment the floors to which a user does not have an access right are arranged to be presented to the user on the touch-sensitive display in a different way than the floors to which the user does have an access right, or they are arranged to be omitted from the aforementioned plurality of floors. In this way those floors that are selectable can be identified for the user and the giving of erroneous calls can be reduced. Preferably a user cannot select as a destination floor a floor to which he/she does not have an access right. In this way a destination call-giving device can function as a part of an access control system.

In one preferred embodiment the aforementioned output comprises a transmitter for transmitting a wireless signal to the control system of the elevator system. In this way by means of the destination call-giving device a destination call can be given from anywhere.

In one preferred embodiment the aforementioned means are arranged to change the selected destination floor within the aforementioned plurality on the basis of at least the distance moved by the touch-sensitive point and the direction of movement, and preferably also on the basis of the speed of the movement of the touch-sensitive point.

In one preferred embodiment the aforementioned means available to a user for selecting a destination floor from a plurality of floors that are in a certain sequence, also function as means for selecting a departure floor from a plurality of floors that are in a certain sequence, and the departure floor is arranged to be selectable by the user in one of the ways described above for selecting a destination floor. In this way a user of a destination call-giving device can select also the floor from which he/she intends to enter the elevator car. In this case the destination call-giving device is well suited, e.g. for a portable destination call-giving device, e.g. a mobile phone or a tablet.

An elevator system according to the invention is additionally disclosed, which system comprises one or more elevator cars, and a control system, which is arranged to control the aforementioned one or more elevator cars on the basis of the destination calls of a destination call-giving device communicating with the aforementioned control system, which destination call-giving device is according to any preceding claim. In this way, inter alia, the advantages mentioned earlier in the description are achieved.

In one preferred embodiment the control system is arranged to allocate (according to a predetermined logic) an elevator car in response to a destination call received from the aforementioned destination call-giving device, and to communicate to the destination call-giving device the allocated elevator car (e.g. the identifier of the elevator car allocated), and the destination call-giving device is arranged to identify for the user, more particularly by presenting (e.g. the identifier of the elevator car allocated) on the touch-sensitive display, the allocated elevator car.

In one preferred embodiment the destination call-giving device is arranged to check the access right of a user, e.g. from the elevator control arrangement, to the floors of the aforementioned plurality and to indicate to the user if the user does not have an access right to some floor. Preferably the floors to which a user does not have an access right are presented/arranged to be presented to the user on the touch-sensitive display in a different way than the floors to which the user does have an access right, or they are arranged to be omitted from the aforementioned plurality of floors.

Also disclosed is a method according to the invention for giving a destination call to the control system of an elevator system, in which method a destination floor is selected from a plurality of floors that are in a certain sequence. In the method the selected destination floor is presented to the user on a touch-sensitive display, the moving of a touch-sensitive point on the touch-sensitive display is detected, the selected destination floor is changed on the basis of the movement of the touch-sensitive point, i.e. in response to the movement of the touch-sensitive point, and a signal containing information identifying the selected destination floor is sent to the control system of the elevator system. In this way quick-to-use selection of a destination floor occurring on the basis of the movement of a touch-sensitive point is simply achieved. Giving a destination call with the method is fast and simple. With the method also advantages corresponding to what is described elsewhere in connection with the description relating to the destination call-giving device can be achieved.

In one preferred embodiment in the method the sliding indicator is presented to the user on a touch-sensitive display and the selected destination floor and the position of the sliding indicator on the touch-sensitive display are changed on the basis of the movement of the touch-sensitive point. Preferably before this a touch of the user is detected at the point of the sliding indicator, and if a touch is detected at the point of the sliding indicator, after it the selected destination floor and the position of the sliding indicator on the touch-sensitive display are changed in the manner specified above. In this way selection of a destination floor occurring on the basis of the movement of a touch-sensitive point can be implemented simply in a quick-to-use manner.

In one preferred embodiment in the method the position of the sliding indicator on the touch-sensitive display is changed in a limited range of movement of the sliding indicator, which range of movement has a first end and a second end, and the position of the sliding indicator at the first end of the range of movement corresponds to the selection of the topmost floor of the aforementioned floor plurality, and the position of the sliding indicator at the second end of the range of movement corresponds to the selection of the bottommost floor of the aforementioned floor plurality. In this way, by means of the range of movement of the sliding indicator, the sequential position of the selected destination floor in the series of selectable floors can be indicated to a user.

In one preferred embodiment in the method a response signal (to the signal sent to it earlier) is received from the control system of the elevator system, which response signal contains information identifying the elevator car, and the information identifying the elevator car is presented to the user on the touch-sensitive display. In this way the elevator car allocated to him/her can be identified for the user.

In one preferred embodiment in the method the selected destination floor is changed in the first direction in sequence within the aforementioned plurality in response to the moving of the touch-sensitive point in a first direction on the touch-sensitive display and the selected destination floor is changed in the second direction in sequence in response to the moving of the touch-sensitive point in a second direction on the touch-sensitive display.

In one preferred embodiment in the method the aforementioned plurality of floors that are in a certain sequence is presented to the user as a series, e.g. as a series of floor identifiers, in which case a floor identifier corresponds to each floor. In this case the series is arranged to be browseable by moving a touch-sensitive point on a touch-sensitive display.

In one preferred embodiment in the method the selected destination floor is changed within the aforementioned plurality on the basis of at least the distance moved by the touch-sensitive point and the direction of movement.

In one preferred embodiment in the method the selected destination floor is changed on the basis of the distance moved by the touch-sensitive point, the direction of movement and on the basis of the speed of the movement of the touch-sensitive point. More particularly, the selected destination floor is changed within the aforementioned plurality on the basis of the distance of movement and the speed of the movement of the touch-sensitive point in such a way that when the touch-sensitive point moves the aforementioned distance at a first speed the selected destination floor is changed within the aforementioned plurality a first amount, and when the touch-sensitive point moves the aforementioned distance at a second speed the selected destination floor is changed within the aforementioned plurality a second amount. When the second speed is greater than the first speed, the change in the number of floors is also greater. For this purpose preferably also the speed of the movement of the touch-sensitive point is determined. This has the advantage that with a short and fast movement of the touch-sensitive point it is possible to browse quickly to close to the desired destination floor and after this to fine-tune the selection with a slow movement. In this way the selection is quick to make, and the touch-sensitive display can be made to be well sufficient in length also in elevator systems having a large number of elevators.

In one preferred embodiment the floors to which a user does not have an access right are presented/arranged to be presented to the user on the touch-sensitive display in a different way than the floors to which the user does have an access right, or they are arranged to be omitted from the aforementioned plurality of floors. In this way it is quick for a user to verify the floors that he/she can select. In this way also the amount of erroneous selections can be reduced.

A computer program product according to the invention is disclosed, which product comprises program commands, which bring a computer provided with a touch-sensitive display and an output to perform a method according to any preceding claim, when they are run in the aforementioned computer, which is arranged to communicate via an output with the control system of the elevator system.

The elevator is most preferably an elevator applicable to the transporting of people and/or of freight, which elevator is installed in a building, to travel in a vertical, or at least essentially vertical, direction, preferably on the basis of calls made at least from a floor landing and possibly also from a car. The elevator car preferably has an interior space, which is suited to receive a passenger or a number of passengers. The elevator preferably comprises at least two, possibly more, floor landings to be served. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments.

BRIEF DESCRIPTION OF THE FIGURES

The invention will now be described in more detail in connection with preferred embodiments, with reference to the attached drawings, wherein.

DETAILED DESCRIPTION OF THE INVENTION

Figure 1:
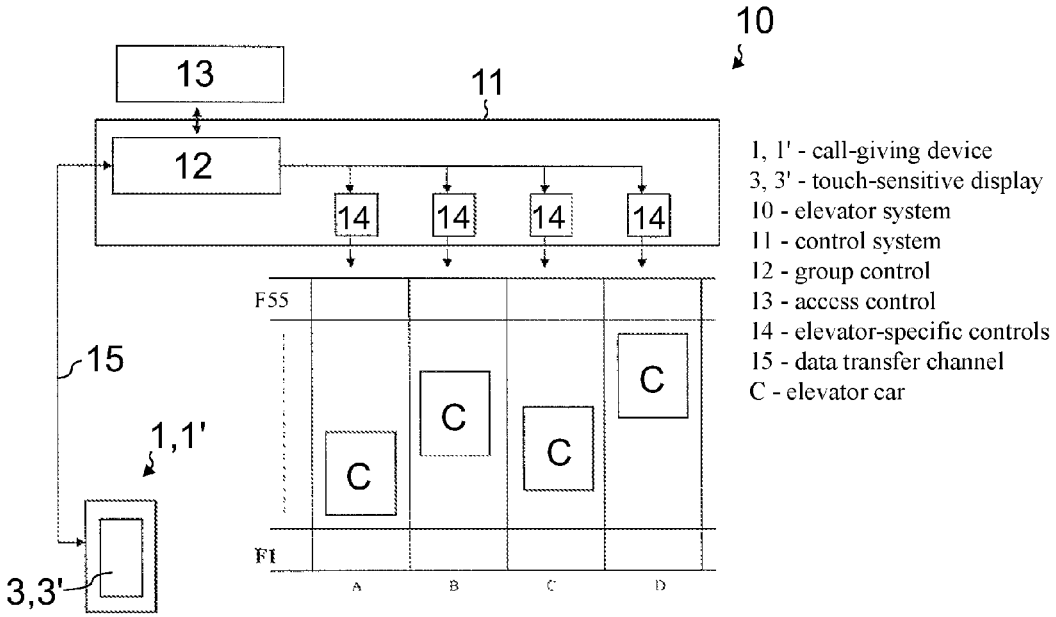
FIG. 1 presents an elevator system according to the invention.

FIG. 1 presents an elevator system 1 according to the invention, which comprises four elevators A, B, C and D and also a control system 11. The control system 11 is arranged to control the elevators A-D, more particularly the elevator cars C of them, on the basis of the destination calls of a destination call-giving device 1,1' communicating with the control system 11. For controlling the elevators, the control system comprises a group control 12 of the elevator system and also elevator-specific controls 14. The elevators serve in this case the floors 1-55 (F1-F55) in the building. A destination call device 1,1' is connected via a data transfer channel 15 to the control system 11, which destination call device is disposed e.g. in the entrance lobby of the building. Alternatively, the destination call device 1,1' can be a portable device, e.g. a mobile phone or a tablet. The data transfer channel 15 can be any wireless or wireline data transfer channel whatsoever that is suited to the purpose. The elevator system here also comprises access control 13, the presence of which is not however necessary. Information about the floors to which a passenger has an access right is transmitted from the access control 13 to the control system 11 and onwards to the destination call device 1,1'. The elevator system functions in such a way that a destination floor is selected with a destination call-giving device 1,1' and a destination call is sent to the control system 11, which destination call contains information about the destination floor selected by the user of the destination call-giving device 1,1', to the control system 11. The control system 11 is arranged to allocate according to a certain predetermined logic some elevator car C of the elevator system in response to a destination call received from the aforementioned destination call-giving device 1,1', and to communicate to the destination call-giving device 1,1' the allocated elevator car, e.g. the identifier (A, B, C or D) of the elevator car allocated, and the destination call-giving device 1,1' identifies for the user, more particularly by presenting the allocated elevator car, e.g. the identifier of the elevator car allocated, on the touch-sensitive display. The control system also controls the allocated elevator car in question to the floor on which the aforementioned destination call was given for taking the user (i.e. passenger) on board, and transports the user to the destination floor. The aforementioned logic selects the most advantageous elevator car C preferably on the basis of predetermined criteria, which elevator car can transport the user of the destination call-giving device (i.e. passenger) to the destination floor. The destination call-giving device 1,1' comprises means available to a user for selecting a destination floor from a plurality of floors that are in a certain sequence, and is arranged to communicate via an output the selected destination floor to the control system 11 of the elevator system 10, which means for selecting a destination floor comprise a touch-sensitive display 3,3' forming a user interface for presenting to the user information related to the selection of a destination floor and for receiving the input of the user. The destination floor is arranged to be selectable by the user from the aforementioned plurality of floors by moving a touch-sensitive point on a touch-sensitive display 3,3'. The aforementioned means for selecting a destination floor, preferably the processing unit 2 (presented in FIG. 4) comprised in them, are arranged to detect the movement of a touch-sensitive point on a touch-sensitive display 3,3', and to change the selected destination floor on the basis of the movement of the touch-sensitive point. The selected destination floor is arranged to be presented to the user on a touch-sensitive display 3,3'. A user can touch the touch-sensitive display 3,3', and move the touch-sensitive point until the selected destination floor corresponds to his/her actual target. In this way a user can make a destination floor selection quickly and changing the selection is rapid. The destination call-giving device 1,1' is preferably one according to the embodiment of a destination call device presented in FIGS. 2-4.

As stated above, the elevator system can also comprise access control 13, the presence of which is not however necessary. In this case it is advantageous that the destination call-giving device is arranged to check the access right of a user to the floors of the aforementioned plurality or to the selected destination floor, and to indicate to the user if the user does not have an access right to some floor. Preferably a user cannot select as a destination floor a floor to which he/she does not have an access right. The indication can be implemented in such a way that the floors to which a user does not have an access right are presented/arranged to be presented to the user on the touch-sensitive display in a different way than the floors to which the user does have an access right, or they are arranged to be omitted from the aforementioned plurality of floors. For example, the floors to which a user does not have an access right can be presented/arranged to be presented to the user with a different color or in a different size than the floors to which the user does have an access right.

Figure 2:
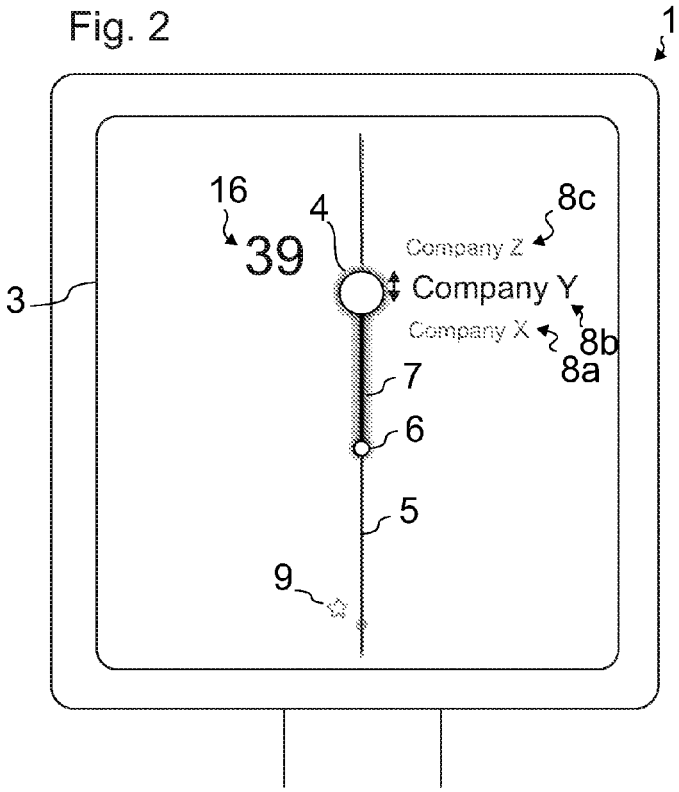
FIG. 2 presents a first embodiment of a call-giving device according to the invention.
Figure 3A:
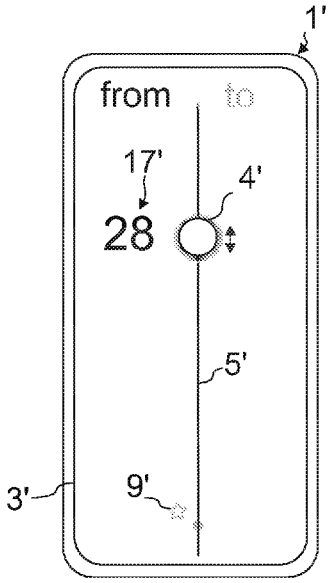
FIG. 3*a* presents a second embodiment of a call-giving device according to the invention, when selecting the departure floor.
Figure 3B:
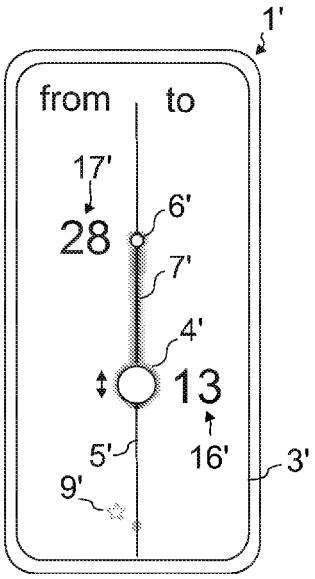
FIG. 3*b* presents a second embodiment of a call-giving device according to the invention, when selecting the destination floor.

FIG. 2 presents a first embodiment of a destination call device and FIGS. 3*a*-3*b* a second embodiment. In the following reference is made to those embodiments, and more particularly to FIGS. 2 and 3*b*, in which the selection of a destination floor is described. In these embodiments the destination call-giving device 1,1' for giving destination calls in an elevator system comprises means available to a user for selecting a destination floor from a plurality of floors that are in a certain sequence, e.g. from a series of floor identifiers arranged in order of magnitude. This plurality of floors can be recorded in the memory M, M' of the destination call-giving device 1,1' or can be picked or remotely read from the memory of the control system of the elevator system. A destination call-giving device 1,1' comprises at least an output $O_1$ for communicating the selected destination floor to the control system 11 of the elevator system 10 via a data transfer channel 15 (presented in FIG. 1) that is between them during communication. The aforementioned means for selecting a destination floor comprise a touch-sensitive display 3,3' and the destination floor 16,16' is arranged to be selectable by the user from the aforementioned plurality of floors by moving a touch-sensitive point on a touch-sensitive display 3,3'. The means for selecting a destination floor are arranged to detect the touch of a user and the movement of a touch-sensitive point on a touch-sensitive display 3,3', and to change the selected destination floor on the basis of the movement of the touch-sensitive point. The selected destination floor 16,16' is arranged to be presented to the user on a touch-sensitive display 3,3'. A user can touch the touch-sensitive display 3,3', and move the touch-sensitive point until the selected destination floor 16,16' corresponds to his/her actual destination. The moving of the touch-sensitive point on the touch-sensitive display 3,3' in the first direction is arranged to change the selected destination floor 16,16' in sequence in a first direction and the moving of the touch-sensitive point on the touch-sensitive display 3,3' in the second direction is arranged to change the selected destination floor in sequence in a second direction. In the embodiments presented the touch-sensitive point, which the user must touch for enabling the described changing of the selection of the destination floor, is indicated to the user on the sliding indicator 4,4'. More particularly, the means for selecting a destination floor are arranged to present on a touch-sensitive display a sliding indicator to be moved in a first and a second direction (described in the figure with a bi-directional arrow), said directions being opposite to each other, which sliding indicator a user can move with the aforementioned movement of a touch-sensitive point changing the destination floor. For achieving this the means P,3,3' for selecting a destination floor are preferably arranged to detect a touch at the point of the sliding indicator 4,4', and to detect the movement of the touch-sensitive point on a touch-sensitive display 3,3', and to change on the basis of the movement of the touch-sensitive point the selected destination floor and the position of the sliding indicator on the touch-sensitive display. By means of the position of the sliding indicator 4,4', the sequential location of the selected destination floor in the aforementioned series of floor plurality is also indicated to the user.

In the preferred embodiment presented the sliding indicator has a limited range of movement on the touch-sensitive display, which range of movement has a first end and a second end. The range of movement is preferably indicated to the user with a straight line 5,5' described on the touch-sensitive display, the length of which line corresponds to the length of the range of movement. Preferably the range of movement of the sliding indicator 4,4' covers the position of the sliding indicator 4,4' for each (every) floor of the aforementioned plurality. In this case the position of the sliding indicator 4,4' at the first end of the range of movement (in the figure, the top end of the indicator 5 of the range of movement) corresponds to the selection of the topmost floor (55 in the elevator system of FIG. 1) of the aforementioned floor plurality, and the position of the sliding indicator at the second end of the range of movement (in the figure, the bottom end of the indicator 5 of the range of movement) corresponds to the selection of the bottommost floor (1 in the elevator system of FIG. 1) of the aforementioned floor plurality. In this way, by means of the range of movement of the sliding indicator, the sequential position of the selected destination floor in the series of selectable floors can be indicated to a user. For achieving this purpose, it is also appropriate that the whole range of movement of the sliding indicator is shown on the touch-sensitive display. The range of movement of the sliding indicator covers preferably at least half, preferably at least 75% of the length of the touch-sensitive display as measured in the direction in which the moving of the aforementioned touch-sensitive point occurs. When the range of movement is long, the selection accuracy is good also when the number of floors is large.

The aforementioned plurality of floors that are in a certain sequence, from which the destination floor is arranged to be selectable, is preferably arranged to be presented to the user as a series, e.g. as a series of floor identifiers, in which case a floor identifier corresponds to each floor. The series is in this case preferably arranged to be browseable, as described above, by moving a touch-sensitive point on the touch-sensitive display 3,3'. In the embodiments of FIGS. 2 and 3*b* the selected destination floor 16,16' is presented to the user on a touch-sensitive display. The series is preferably arranged in order of magnitude when a series of floor identifiers in number format are involved. Moving of the touch-sensitive point in a first direction (in the figures, upwards) of the touch-sensitive area changes the selected destination floor 16,16' to be larger in sequence, i.e. the changed destination floor would be 40.

The aforementioned sliding indicator 4,4' is preferably at the moment of starting to give a call at the point of the touch-sensitive display that corresponds to the sequential position of the departure floor in the aforementioned floor plurality. For example, when the departure floor is the topmost floor of the aforementioned floor plurality, the sliding indicator 4,4' is preferably at the moment of starting to give a call at the first end of its range of movement. Correspondingly, when the departure floor is the bottom-most floor of the aforementioned floor plurality, the sliding indicator 4,4' is preferably at the moment of starting to give a call at the second end of its range of movement. Correspondingly, when the departure floor is the centermost floor of the aforementioned floor plurality, the sliding indicator 4,4' is preferably at the moment of starting to give a call at the center point of its range of movement. Preferably a departure floor indicator 6,6', which is in position regardless of the movement of the sliding indicator, is arranged to be presented on the touch-sensitive display. In this way the user can without problem diagnose the movement of the touch-sensitive point, and the flawless operation of the device. Preferably a line 7,7' is arranged to be drawn on the touch-sensitive display between the departure floor indicator 6,6' and the sliding indicator 4,4' when the sliding indicator 4,4' moves. In this way it is easy for the user to diagnose the movement of the touch-sensitive point, and the flawless operation of the device. Preferably a main lobby floor indicator 9,9' of the building is also arranged to be presented on the touch-sensitive display in a point that corresponds to the sequential location of the floor in question in the aforementioned floor plurality. A user can quickly select the floor in question as the destination floor by displacing the sliding indicator 4,4' to the point of the main lobby floor indicator 9,9'.

In the embodiment presented in FIG. 2 the destination call-giving device 1 is a destination call-giving device permanently installed into its position in the proximity of the elevators A-D of the elevator system, preferably in an elevator lobby. In practice, the destination call-giving device 1 can be e.g. supported on the floor or wall of an elevator lobby. When the location of the destination call-giving device 1 is known the departure floor is also known, in which case determination of the departure floor is not needed. The destination call-giving device 1 can e.g. include its own identifier (e.g. from the memory M) of a destination call signal communicated by it to the elevator control 11, in which case the elevator control system 11 detects the floor from which the call came. In this embodiment information 8*b* relating to the selected destination floor 16 is also arranged to be presented on the display to the user. Information 8*a*, 8*c* of the floor preceding and of the floor following the selected destination floor 16 is also arranged to be presented to the user. The information 8*a*-8*b* relating to the floor can be something other than the number identifier of the destination floor, and can comprise e.g. the name of a company operating on the floor or a description of a service being offered on the floor or the name of the tenant of the floor or the name of the resident of the floor or the name of a department operating on the floor.

In the embodiment presented in FIGS. 3*a* and 3*b* the destination call-giving device 1' is a portable destination call-giving device. In this case the destination call-giving device 1' is preferably a mobile phone. In this embodiment the selection of the destination floor occurs as is described earlier in the preceding and presented in FIG. 3*b*. The selection functions for the destination floor can be preceded by the selection of the departure floor, which is illustrated in FIG. 3*a*. If the elevator system 10 does not know the location of the destination call-giving device 1', the departure floor is also selected using the destination call-giving device 1' and the selected departure floor is communicated to the elevator control system 11 of the elevator system. This is preferably done using the same means as the selection of the destination floor, in which case the aforementioned means (2,3,3') available to a user for selecting a destination floor from a plurality of floors that are in a certain sequence function also as the means for selecting the departure floor from the plurality of floors that are in a certain sequence. Likewise the output O1 can be used for communicating the selected departure floor to the control system 11 of the elevator system 10. The selected departure floor is communicated to the elevator system 11 together with the selected destination floor, as a part of the destination call to be sent to the elevator system 11. The aforementioned means 2,3' available to a user for selecting a destination floor from a plurality of floors that are in a certain sequence also function as means for selecting a departure floor from a plurality of floors that are in a certain sequence, and the departure floor is arranged to be selectable by the user in a corresponding way to the destination floor. Thus also the departure floor 17' is arranged to be selectable by the user from the aforementioned plurality of floors by moving a touch-sensitive point on a touch-sensitive display 3'. The means for selecting a departure floor are arranged to detect the touch of a user and the movement of a touch-sensitive point on a touch-sensitive display 3', and to change the selected departure floor on the basis of the movement of the touch-sensitive point. The selected departure floor 17' is presented to the user on a touch-sensitive display. The aforementioned plurality of floors that are in a certain sequence, from which the departure floor is arranged to be selectable, is preferably arranged to be presented to the user as a series, e.g. as a series of floor identifiers, in which case a floor identifier corresponds to each floor. In the embodiments presented the touch-sensitive point, which the user must touch for enabling the described changing of the selection of the departure floor, is indicated to the user on the sliding indicator 4'. More particularly, the means for selecting a departure floor are arranged to present on a touch-sensitive display a sliding indicator to be moved in a first and a second direction (described in the figure with a bi-directional arrow), said directions being opposite to each other, which sliding indicator a user can move with the aforementioned movement of a touch-sensitive point changing the departure floor. For achieving this the means P,3' for selecting a destination floor are preferably arranged to detect a touch at the point of the sliding indicator 4', and to detect movement of the touch-sensitive point on the touch-sensitive display 3', and to change the selected departure floor and the position of the sliding indicator on the touch-sensitive display on the basis of the movement of the touch-sensitive point. By means of the position of the sliding indicator 4', the sequential location of the departure floor in the series of the aforementioned floor plurality is also indicated to the user. In the preferred embodiment presented the sliding indicator has a limited range of movement on the touch-sensitive display, which range of movement has a first end and a second end. The range of movement is preferably indicated to the user with a straight line 5' described on the touch-sensitive display, the length of which line corresponds to the length of the range of movement. FIGS. 3*a* and 3*b* also present how indicators (to and from) are preferably arranged to be presented on the touch-sensitive display to indicate whether it concerns a departure floor or a destination floor. Preferably a departure floor is arranged to be selectable first with the functions according to FIG. 3*a* and after this the destination floor with the functions according to FIG. 3*b*.

In the method according to the invention for giving a destination call in an elevator system a destination floor is selected from a plurality of floors that are in a certain sequence. The method is suited to be performed e.g. with any destination call-giving device 1,1', having a touch-sensitive display, described elsewhere in this application. The method is suited to be performed in any type of elevator system described elsewhere in this application, in which case a destination call is given for sending to the elevator control system 11 of the elevator system 10. In the method these phases are performed:

- the selected destination floor is presented to the user on a touch-sensitive display 3,3',
- the moving of a touch-sensitive point on the touch-sensitive display 3,3' is detected,
- the selected destination floor is changed on the basis of the movement of the touch-sensitive point, more particularly in response to the movement of the touch-sensitive point,
- a signal containing information identifying the selected destination floor is sent to the control system 11 of the elevator system 10.

Before the aforementioned phases, it has been possible to detect the taking into use of the touch-sensitive display by an action of the user, e.g. detecting a touch of the user on some predetermined point of the touch-sensitive display.

In the method preferably also the sliding indicator is presented to the user on a touch-sensitive display 3,3' and the selected destination floor and the position of the sliding indicator on the touch-sensitive display are changed on the basis of the movement of the touch-sensitive point. Preferably before this, however, a touch of the user is detected at the point of the sliding indicator, and if a touch of the user is detected at the point of the sliding indicator, after it the selected destination floor and the position of the sliding indicator on the touch-sensitive display are changed in the manner specified above.

For implementing the aforementioned phases of the method a processor unit 2 preferably comprised in a destination call-giving device 1,1' can be used, which processor unit is in connection with the touch-sensitive display 3,3' via an input I2 and an output O2, via which input I2 the processing unit 2 receives inputs made by the user as touches on the touch-sensitive display, and via which output O2 the processing unit 2 sends information to the touch-sensitive display to be presented. In this way the processor unit 2 can change the information to be sent to the touch-sensitive display in response to an input given by the user via the touch-sensitive display. For example, when the processor unit 2 detects that a user has moved the touch-sensitive point on the touch-sensitive display, it changes the selected destination floor and sends to the touch-sensitive display a signal to present the changed destination floor on the touch-sensitive display, and in addition a signal for presenting the sliding indicator in a new point on the touch-sensitive display.

Preferably in the method the processing unit 2 changes the position of the sliding indicator on the touch-sensitive display in a limited range of movement of the sliding indicator, which range of movement has a first end and a second end, and wherein the position of the sliding indicator at the first end of the range of movement corresponds to the selection of the topmost floor of the aforementioned floor plurality, and the position of the sliding indicator at the second end of the range of movement corresponds to the selection of the bottommost floor of the aforementioned floor plurality.

Preferably in the method after the sending of a signal containing information identifying the selected destination floor the processing unit 2 receives a response signal to the signal sent to it earlier from the control system 11 of the elevator system 10 which response signal contains information identifying the elevator car C, and presents the information identifying the elevator car C to the user on the touch-sensitive display.

Preferably in the method the processing unit 2 changes the selected destination floor in the first direction in sequence within the aforementioned plurality in response to the moving of the touch-sensitive point in a first direction on the touch-sensitive display and the selected destination floor is changed in the second direction in sequence in response to the moving of the touch-sensitive point in a second direction on the touch-sensitive display.

Preferably in the method the aforementioned plurality of floors that are in a certain sequence is presented to the user as a series, e.g. as a series of floor identifiers, in which case a floor identifier corresponds to each floor. In this case the series is arranged to be browseable by moving a touch-sensitive point on the touch-sensitive display 3,3'.

As described in the preceding, preferably in the method the processing unit 2 changes the selected destination floor within the aforementioned plurality on the basis of the movement distance and movement direction. In one preferred embodiment the amount of the change in destination floor within the aforementioned plurality depends both on the distance moved by the touch-sensitive point and on the movement speed of the touch-sensitive point. More particularly, in the method the processing unit 2 changes the selected destination floor within the aforementioned plurality on the basis of the movement distance and movement speed in such a way that when the touch-sensitive point moves the aforementioned distance at a first speed the selected destination floor is changed within the aforementioned plurality a first amount, and when the touch-sensitive point moves the aforementioned distance at a second speed the selected destination floor is changed within the aforementioned plurality a second amount. When the second speed is greater than the first speed, the change in the number of floors is also greater. For this purpose preferably also the speed of the movement of the touch-sensitive point is determined. Based on this the amount of the change in destination floor is determined in the manner described above. In this way when a user moves the touch-sensitive point at a low movement speed, the floor selection changes for a certain contact distance only a small amount and when a user moves the touch-sensitive point at a high movement speed, the floor selection changes for a certain contact distance a large amount. This has the advantage that with a short and fast movement of the touch-sensitive point it is possible to browse quickly to close to the desired destination floor and after this to fine-tune the selection with a slow movement. In this way the touch-sensitive display can be made to be well sufficient in length also in elevator systems having a large number of floors.

The computer program product according to the invention comprises program commands, which bring a computer provided with a touch-sensitive display 3,3' and with an output $O_1$ to perform a method according to what is described above, when they are run in the aforementioned computer, which is connected as a part of the elevator system and is arranged to communicate via the output $O_1$ with the control system of the elevator system. The aforementioned computer provided with a touch-sensitive display 3,3' and an output $O_1$ can be e.g. in the form of a mobile phone. A computer program product can be e.g. a computer program to be downloaded into a computer. The computer program can be a so-called application. The computer program product is preferably a computer program, which is arranged to be executed under the subordination of an operating system. The operating system can be e.g. iOS, Windows, Android or Symbian.

The computer program can be stored in some type of conveying means, which can be any entity or device whatsoever that is able to store a program. Such conveying means comprise e.g. a recording means, a computer memory, a read-only memory, an electrical carrier wave, a telecommunications signal, and a software distribution package. A computer program can be e.g. in source code format, in object code format or in some intermediate format.

Figure 4:
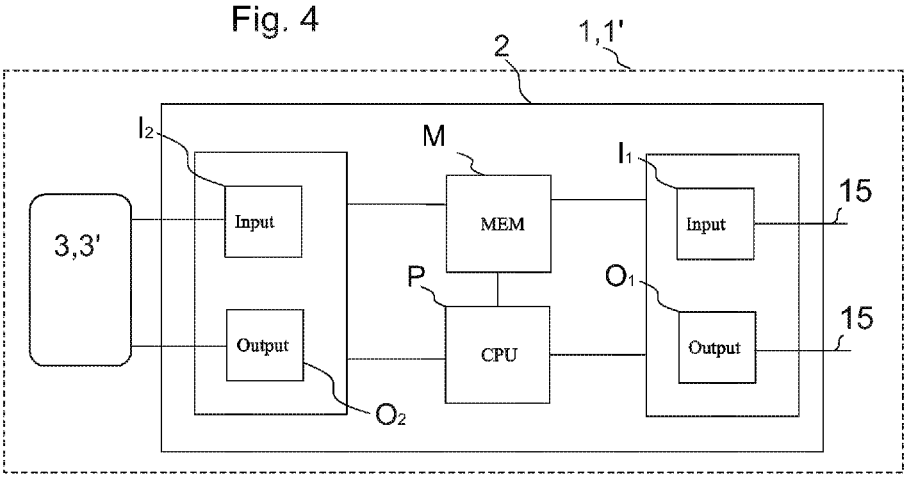
FIG. 4 presents one preferred structure of the call-giving device.

FIG. 4 presents by way of reference a preferred structure for a destination call-giving device 1,1'. The means comprised in the destination call-giving device 1,1' and available to a user for selecting a destination floor comprise a processing unit 2 for processing a touch signal received from the touch-sensitive display 3,3' and for executing program commands. The processing unit 2 comprises at least one processor P, which can be brought into data transfer connection with a memory M, which is preferably also comprised in the processing unit 2. Alternatively the memory is separate to the processing unit 2. The memory stores at least program commands and preferably also information related to floors. The processing unit 2 is arranged to execute program commands stored in the memory M, which commands can be in the format of the software product mentioned earlier. For processing the touch signal and for executing program commands the processing unit 2 comprises, in addition to a processor P and a memory, connected to the processor an input I1 from the control system of the elevator system, and an input I2 from the touch-sensitive display, and an output O1 to the control system of the elevator system, and an output O2 to the touch-sensitive display. Each of the aforementioned inputs and outputs is preferably able to transmit an electrical signal. Some of these signals can be wireless, e.g. the aforementioned output O1 to the control system of the elevator system can comprise a transmitter for transmitting a wireless signal to the control system 11 of the elevator system 10. This is advantageous e.g. when the destination call-giving device is portable.

In the embodiments presented above the selected destination floor/departure floor can also be arranged to be confirmable (not presented), e.g. with a certain touch function in which case the sending of a destination call can be started after the confirmation. Presented above are embodiments in which there is a sliding indicator, but it is possible to utilize the invention within the scope of the basic concept of the invention also without a sliding indicator. For example, moving a touch-sensitive point falling anywhere at all on the touch-sensitive display can be arranged to change the selected destination floor in one of the ways specified earlier. On the other hand, another type of indicator can alternatively be arranged to be presented on the touch-sensitive display. For example, a destination floor number bar or destination floor number queue, which is arranged to move according to the movement of the touch-sensitive point moving the selected destination floor, can be arranged to be presented on the touch-sensitive display. In this case the destination floor number transferred to a specified location on the touch-sensitive display with the movement of the touch-sensitive point can be identified as the selected destination floor. It is obvious to the person skilled in the art that in developing the technology the basic concept of the invention can be implemented in many different ways. The invention and the embodiments of it are not therefore limited to the examples described above, but instead they may be varied within the scope of the claims.

The invention claimed is:

1. A destination call-giving device for giving destination calls in an elevator system, said destination call-giving device comprising:

a device available to a user for selecting a destination floor from a plurality of floors that are in a certain sequence; and an output for communicating the selected destination floor to a control system of the elevator system, wherein the device for selecting a destination floor comprises a touch-sensitive display forming a user interface for presenting to the user information related to the selection of a destination floor and for receiving the input of the user, and wherein the destination floor is arranged to be selectable by the user from the plurality of floors by moving a touch-sensitive point on touch-sensitive display, wherein the touch-sensitive display includes a sliding indicator configured to be moved along a line in a first direction to an upmost point indicating a topmost floor and along the line in a second direction to a bottommost floor, said directions being opposite to each other, which sliding indicator can be moved with movement of a touch-sensitive point to change the selected destination floor, and wherein an initial position of the sliding indicator along said line corresponds to a sequential position of a departure floor.

2. The destination call-giving device according to claim 1, wherein the device for selecting a destination floor comprises a processing unit in data transfer connection with the touch-sensitive display for processing a touch signal received from the touch-sensitive display and for executing program commands, which processing unit comprises a processor, which can be brought into data transfer connection with a memory, which is comprised in the processing unit or is separate from the processing unit and stores program commands and/or information relating to the floor plurality.

3. The destination call-giving device according to claim 1, wherein the range of movement of the sliding indicator covers the position of the sliding indicator for each (every) floor of the floor plurality.

4. The destination call-giving device according to claim 1, wherein the destination call-giving device is a portable destination call-giving device.

5. The destination call-giving device according to claim 1, wherein the plurality of floors that are in a certain sequence, from which the destination floor is arranged to be selectable, is arranged to be presented to the user as a series on a touch-sensitive display, which series is arranged to be browseable by moving the touch-sensitive point on the touch-sensitive display.

6. The destination call-giving device according to claim 1, wherein the selected destination floor is arranged to be presented to the user on a touch-sensitive display.

7. An elevator system comprising:

one or more elevator cars; and a control system, which is arranged to control the one or more elevator cars on the basis of destination calls of a destination call-giving device communicating with the control system, which destination call-giving device is according to claim 1.

8. The elevator system according to claim 7, wherein the control system is arranged to allocate an elevator car in response to a destination call received from the destination call-giving device, and to communicate to the destination call-giving device the allocate elevator car, and the destination call-giving device is arranged to identify for the user the allocated elevator car with the touch-sensitive display.

9. A method for giving a destination call to a control system of an elevator system, in which method a destination floor is selected from a plurality of floors that are in a certain sequence, said method comprising the steps of:

presenting the selected destination floor to the user on a touch-sensitive display, the touch sensitive display includes a sliding indicator configure to be moved along a line in a first direction to an upmost point indicating a topmost floor and to be moved along the line in a second direction to a bottommost floor, said directions being opposite to each other, which sliding indicator can be moved with movement of a touch-sensitive point to change the selected destination floor, an initial position of the sliding indicator along said line corresponds to a sequential position of a departure floor;

detecting the moving of a touch-sensitive point along said line on the touch-sensitive display;

changing the selected destination floor on the basis of the movement of the touch-sensitive point; and sending a signal containing information identifying the selected destination floor to the control system of the elevator system.

10. The method according to claim 9, wherein a response signal to the destination call signal sent to it earlier is received from the control system of the elevator system, which response signal contains information identifying the elevator car, and the information identifying the elevator car is presented to the user on the touch-sensitive display.

11. The method according to claim 9, wherein the selected destination floor is changed within the plurality on the basis of at least the movement distance and movement direction of the touch-sensitive point and also on the basis of the speed of the movement of the touch-sensitive point.

12. A computer program product, which comprises program commands, which bring a computer provided with a touch-sensitive display and an output to perform a method according to claim 9, when the program commands are run in the computer, which is arranged to communicate via the output with the control system of the elevator system.

13. The elevator system according to claim 7, wherein the control system is configured to determine access rights of a user, including which floors the user has access to, and to display on the touch-sensitive display floors to which the user does not have access rights differently than the floors that the user does have access rights.

14. The method according to claim 9, further comprising determining access rights of a user, including which floors the user has access to, and displaying on the touch-sensitive display floors to which the user does not have access rights differently than the floors that the user does have an access rights.

15. The destination call-giving device according to claim 4, wherein the departure floor is selected by a user via a touch-input applied to the touch-sensitive display.

16. The method according to claim 9, wherein the touch-sensitive display is part of a portable destination call-giving device, and the method further comprises selecting the departure floor via a touch-input applied to the touch-sensitive display.

* * * * *